United States Patent [19]

Hülsmann

[11] Patent Number: 4,510,093

[45] Date of Patent: Apr. 9, 1985

[54] SYNTHETIC LIQUID WAX ESTERS

[75] Inventor: Hans L. Hülsmann, Wetter, Fed. Rep. of Germany

[73] Assignee: Dynamit Nobel Aktiengesellschaft, Troisdorf, Fed. Rep. of Germany

[21] Appl. No.: 472,457

[22] Filed: Mar. 7, 1983

[30] Foreign Application Priority Data

Mar. 12, 1982 [DE] Fed. Rep. of Germany ..... 3208930

[51] Int. Cl.[3] ..... C11C 3/02

[52] U.S. Cl. ..... 260/410.9 N; 252/106; 424/59; 424/60; 424/64; 424/65; 424/70

[58] Field of Search ..... 424/358; 260/410.9 N

[56] References Cited

U.S. PATENT DOCUMENTS

| | | | |
|---|---|---|---|
| 1,944,887 | 1/1934 | Graves | 260/410.9 N |
| 4,315,040 | 2/1982 | Heine et al. | 260/410.9 N |
| 4,428,885 | 1/1984 | Higaki et al. | 424/358 |

*Primary Examiner*—Dale R. Ore

*Attorney, Agent, or Firm*—Felfe & Lynch

[57] ABSTRACT

A synthetic unsaturated wax ester prepared from unsaturated carboxylic acids of 18 to 22 carbon atoms and unsaturated fatty alcohols of 12 to 22 carbon atoms is proposed as a substitute for jojoba oil.

9 Claims, No Drawings

SYNTHETIC LIQUID WAX ESTERS

BACKGROUND OF THE INVENTION

The invention relates to synthetic liquid wax esters of the joboba oil type on the basis of long-chain alkenes and alkenic acids which are free of glycerin and/or glycerin derivatives.

Natural jojoba oil is obtained from the fruits of a number of desert plants from the family of the Buxaceae, which are native to California and Mexico among other places. Jojoba oil is not a fatty oil in the conventional sense, that is, not an ester of glycerin with fatty acids, but in its chemical structure it is a liquid wax composed of esters of monounsaturated straight-chain alcohols and acids with chain length maxima at 20 to 22 carbon atoms.

The cosmetics industry has a growing interest in liquid waxes of the jojoba type, which is met at the present time, however, by a very small offering of varying quality, for example with frequently unsatisfactory turbidity points, from material gathered from wild plants, since the small amount of plantation farming being done is not yet producing a yield.

The properties of jojoba oil are unusual and quite different from those of fatty oils; in spite of the unsaturated bond in the two ester components, the oil does not turn rancid; the degradation point is at about 300° C.; the oil keeps without spoiling for many years; its compatibility when applied to the skin and internally consumed is very good, although the oil is indigestible.

Only sperm oil from the nasal cavities of the sperm whale, which contains approximately 30% of fatty acids of glycerin in addition to long-chain liquid waxes, has some properties of similar value, but at the present time it is no longer available in appreciable quantities. The synthesis of jojoba oil has not been possible at reasonable cost.

Accordingly, the problem existed of producing a substitute for natural jojoba oil from raw materials easily available in sufficient quantities, which would offer the attractiveness of the natural product.

THE INVENTION

The subject matter of the invention is synthetic liquid wax esters of the jojoba oil type, consisting of ester mixtures of substantially equivalent amounts of an unsaturated carboxylic acid component a and an unsaturated alcohol component b, in which component a consists of $a_1$ 5 to 95% of monounsaturated $C_{22}$ straight-chain fatty acids
0 to 10% of monounsaturated $C_{20}$ straight-chain fatty acids
0 to 60% of monounsaturated $C_{18}$ straight-chain fatty acids
0 to 25% of diunsaturated $C_{18}$ straight-chain fatty acids
0 to 8% of triunsaturated $C_{18}$ straight-chain fatty acids, $a_2$ 0 to 25% of addition products of acrylic acid onto conjugated straight-chain fatty acids, and $a_3$ 0 to 25% of dimeric fatty acids, and component b consists of 0 to 10% of unsaturated $C_{12}$ fatty alcohols
0 to 15% of unsaturated $C_{14}$ fatty alcohols
0 to 40% of unsaturated $C_{16}$ fatty alcohols
50 to 95% of unsaturated $C_{18}$ fatty alcohols
0 to 10% of unsaturated $C_{20}$ fatty alcohols
0 to 10% of unsaturated $C_{22}$ fatty alcohols, the components of a and b totaling 100% in each case.

Except for any impurities that might be present, the unsaturated alcohol component of the liquid wax esters contain only monounsaturated, straight-chain primary alcohols which are prepared technically by the high-pressure hydrogenation of unsaturated fatty acids. A content of octadecene-1-ol is always to be present, the content of the rest of the primary alcohols and the location of the double bond being able to differ according to the starting substances used in the hydrogenation. It is preferred that, additionally, contents of the $C_{14}$, $C_{16}$ and $C_{20}$ alcohols (tetradecen-1-ol, hexadecen-1-ol and eicosen-1-ol) be present, the $C_{14}$ alcohols very preferably in amounts of 2 to 15% and the $C_{16}$ alcohols in amounts of 2 to 40%.

The component of the unsaturated carboxylic acids can consist only of straight-chain monocarboxylic acids of the component $a_1$ or additionally of the acids of component $a_2$ and/or $a_3$.

In component $a_1$, the monounsaturated $C_{22}$ acid (docosenoic acid) is always to be present, isomers with the double bond in different positions occurring, one of the important ones being cis-13-docosenoic acid (13c-C22:1), i.e., erucic acid. The most frequent monounsaturated $C_{20}$ fatty acid is cis-9-eicosenoic acid (9c-C20:1), and the most frequent unsaturated $C_{18}$ fatty acid is cis-9-octadecenoic acid (9c-C18:1). The other components of component $a_1$ as well as the components $a_2$ and $a_3$ serve especially for the adjustment and variation of important properties such as iodine number, viscosity or turbidity point. A diunsaturated $C_{18}$ fatty acid can be especially cis-9-, cis-12-octadecadienoic acid (9c, 12c-C18:2), and a triunsaturated acid can be especially cis-9, cis-12, cis-15-octadecatrienoic acid (9c, 12c, 15c-C18:3), but their isomers with the double bonds in different positions can also be used.

Depending on the selection of the commercial unsaturated alcohols and of the carboxylic acids, impurities are frequently unavoidable in amounts of up to about 3% by weight, especially saturated alcohols and saturated carboxylic acids, but they do no harm.

$C_{21}$ dicarboxylic acids can be contained in component $a_2$ in amounts of 0 to 25%, forming by Diels-Alder addition of acrylic acid onto the conjugated double bond, especially of linoleic acid. Principal components of the addition products are 6-carboxy-4-hexyl-2-cyclohexene-octanoicacid-1 of the formula

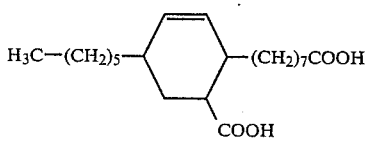

and 5-carboxy-4-hexyl-2-cyclohexene-octanoicacid-1 of the formula

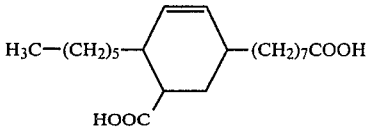

(B. F. Ward et al: J. Am. Oil Chem. Soc. vol. 52 No. 7 (1975) pp 219–224). Components $a_3$ can be the so-called "dimeric fatty acids", namely the condensation products formed from fatty acids by the alkaline catalytic treatment of certain fatty acids as described, for example, by E. H. Pryde: Fatty Acids, Copyright 1979 by the American Oil Chemists Society. Chief components are acyclic, monocyclic and bicyclic acids of the types

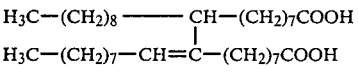

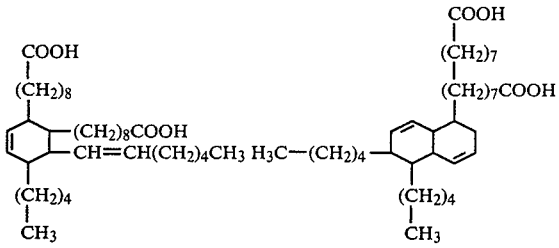

plus other components, including small amounts of trimerization products as well as unmodified and isomerized fatty acids.

The synthetic liquid wax esters are preferably neutral esters having a low acid number in the range from 0 to 5, and a low hydroxyl number in the range from 0 to 10.

If desired, however, by a slight departure from the equivalence of the carboxyl groups and hydroxyl groups in components a and b, esters containing carboxyl or hydroxyl groups can also be prepared.

If an excess of alcohols is desirable in the esterification, the excess hydroxyl groups after the esterification can be esterified by reaction with, for example, acetic anhydride, so that then acetyl radicals are contained in the product in amounts of 0 to 5% by weight.

The preparation of the synthetic wax esters is performed by the esterification of mixtures of acids of component a with mixtures of component b by methods known in themselves. Components a and b can be used in equivalent amounts with respect to the carboxyl group and hydroxyl group content, or at first there may be an excess of one component for the purpose of accelerating the esterification. Unesterified starting substances can be distilled out after the reaction or removed by refinement with acids or bases, or they may remain in the product as acetyl derivatives produced by the above-mentioned reaction with acetic anhydride.

The catalysts can be the conventional esterification catalysts, preferably zinc salts such as zinc acetate, or organic titanic acid derivatives such as tetrabutyl titanate, in amounts of 0.05 to 2% of the weight of the starting substances. The reaction is performed at temperatures in the range of 120° to 200° C., preferably 140° to 160° C., with the exclusion of oxygen, preferably in a nitrogen atmosphere. For the more rapid removal of the reaction water, a withdrawing agent such as xylene, for example, can be added. After the separation of the calculated amount of water, any withdrawing agent that may have been added, plus any unesterified starting substances, if neutral esters are being produced, are removed and the esters are refined, deodorized, bleached and dried in a conventional manner.

The synthetic wax esters surprisingly have all of the attractive features of jojoba oil, which are singular among the esters occurring in nature, in spite of their different chemical composition, to the degree that products can be made which are confusingly similar to jojoba oil, and excelling the natural product in important and distinctive characteristics. Advantages result especially from the high iodine number, low peroxide number, low viscosity and low turbidity points. It is especially to be stressed that the products of the invention do not turn rancid, are very well tolerated on the skin, and have skin-care qualities, and, with $LD_{50}$ ratings of more than 20 g/kg, are so nontoxic that they can serve as a dietetic component, since they are but slightly digestible and are of low nutritional value. Their molecular structure is unusually stable, with a thermal stability better than 300° C.; they have great resistance to oxygen even at high temperatures due to very low peroxide numbers, and high stability against enzymatic attack in the presence of water or hydrolases. The wax esters contain no hydrocarbons, steroids, sterols, free alcohols or acids, or other accompanying substances which might be objectionable from the physiological and toxicological viewpoint as allergens or eczematogens, for example. The products can on the one hand be made to match the characteristic properties of natural jojoba oil, or even particularly high-quality lots of jojoba oil. On the other hand, these characteristics are so variable that, for particular applications, they can be made better than the natural product. Especially with regard to the iodine number, low peroxide number, low viscosity, and the turbidity points, which can be as much as 10° C. lower, the natural product is excelled. Compared with a synthetic symmetrical ester of monounsaturated $C_{20}$ alcohol and monounsaturated $C_{20}$ fatty acid, which is not homogeneous below 18° C., the wax esters of the invention also have advantages in their turbidity points, which are as much as 10° C. lower. The products of the invention, therefore, can replace natural jojoba oil in all preparations, and sperm oil as well, over which it has the advantage of freedom from lipids, i.e., glycerin esters.

The liquid wax esters can be the basis for or adjuvants in cosmetic formulations, for example, such as creams, lotions, skin and hair oils, shampoos, sunscreens, lipsticks, deodorants and soaps, and in dietetic preparations; they can also serve as vehicles in pharmaceutical preparations. They can be worked together with the vegetable, animal and synthetic oils, fats and waxes to form, for example, very stable water-oil or oil-water emulsions. They have outstanding lubricating qualities and are therefore usable as they are or as components of alloyed lubricant systems. Furthermore, they can be modified chemically in many ways, and made into valuable series of products for technical applications, such as in fabrication operations involving machining, pressing or rolling. By hydrogenation, waxes can be produced having a semisolid to solid consistency, high-pressure lubricants can be made by addition reaction with sulfur, and intermediates of various kinds can be prepared by epoxidation, chlorination or isomerization.

To further improve the stability of the products against oxygen attack, acceptable antioxidants can be dissolved in them, such as, for example, 2(3)-tert.-butyl-4-hydroxyanisole or-toluene (TBHA and BHT, respectively), in amounts of 0 to 1% by weight. Products thus stabilized are virtually unaltered in peroxide number, color and sensory properties after 200 hours of exposure to air in a stream of fine bubbles at 90° C.

Also subject matter of the invention is the use of the products as substitutes for jojoba oil.

EXAMPLES

In a heated three-necked flask equipped with thermometer, stirrer, reflux condenser and water separator, one mole of a mixture of the acids of the composition given under in columns 1 to 6 is heated at 140° to 160° C. under nitrogen with 0.9 to 1.1 moles of a mixture of the alcohols of the composition A1 to A3 with the addition of 100 ml of dry xylene as withdrawing agent, and 0.1 wt.-% of zinc acetate, while the withdrawing agent withdraws the reaction water as it is refluxed.

The acid mixtures are composed as follows (stated in percent by weight), the acids having the cis configuration and being mostly in the position named in each case in the description:

| | C18:1 | C18:2 | C18:3 | C20:1 | C22:1 | * | ** | By-prod. |
|---|---|---|---|---|---|---|---|---|
| S1 | 1 | 0.1 | 0.3 | 2 | 95 | — | — | 1.6 |
| S2 | 50 | 15 | 3 | 4 | 24 | 2 | — | 2 |
| S3 | 70 | 8 | 2 | 1 | 18 | — | — | 1 |
| S4 | 60 | 10 | 8 | 2 | 14 | — | 3 | 3 |
| S5 | 50 | 15 | 4 | 3 | 15 | 11 | — | 2 |
| S6 | 50 | 12 | 3 | 2 | 15 | 10 | 5 | 3 |

* = $C_{21}$ dicarboxylic acids of component $a_2$
** = Dimeric fatty acids of component $a_3$ The alcohol mixtures are of the following composition (wt-%):

| | C14:1 | C16:1 | C18:1 | C20:1 | By-products |
|---|---|---|---|---|---|
| A1 | 3 | 5 | 85 | 4 | 3 |
| A2 | 4 | 13 | 80 | 2 | 1 |
| A3 | 6 | 17 | 74 | 1 | 2 |

After an esterification period of about 6 hours the calculated quantity of water was obtained. The reactant excess is distilled off in vacuo. The crude ester is extracted with water, neutralised with bicarbonate or soda lye and, in case, acetylated with a quantity of acetic anhydride equivalent to the hydroxyl number of the crude ester, neutrally washed with water, bleached with active carbon and/or bleaching earths, deodorised and dried. The yields of ester are approx. quantitative, referred to the amount of the component somewhat lower than the equivalent.

The obtained esters and their properties are listed in the following table. Herein S1/A1 and the subsequent compositions are each neutral esters from the indicated components. The viscosities are measured in $mm^2$/sec.

It will be understood that the specification and examples are illustrative but not limitative of the present invention and that other embodiments within the spirit and scope of the invention will suggest themselves to those skilled in the art.

| Ester | S1/A1 | S2/A3 | S3/A3 | S4/A2 | S1/A2 | S3/A1 | S5/A1 | S6/A3 | * |
|---|---|---|---|---|---|---|---|---|---|
| Verseifungszahl Saponification No. | 104 | 98 | 101 | 97 | 102 | 99 | 96 | 97 | 94 |
| Jodzahl Iodine number | 85 | 92 | 90 | 89 | 91 | 89 | 87 | 85 | 83 |
| Peroxidzahl Peroxide number | 1,6 | 3,1 | 1,4 | 2.0 | 1,5 | 1,8 | 1,0 | 0,5 | 9,4 |
| $n_D^{20}$ | 1,464 | 1,464 | 1,465 | 1,465 | 1,464 | 1,464 | 1,466 | 1,465 | 1,465 |
| Dichte (20° C.) Specific gravity | 0,864 | 0,863 | 0,863 | 0,862 | 0,863 | 0,863 | 0,862 | 0,863 | 0,861 |
| Viskositat(40° C.) Viscosity | 16,3 | 16,4 | 16,3 | 16,5 | 16,6 | 16,3 | 25,5 | 28,0 | 25,8 |
| Viskositat (95° C.) Viscosity | 5,0 | 5,1 | 5,0 | 5,1 | 5,1 | 5,0 | 6,6 | 7,7 | 7,1 |
| Trubungspunkt (°C.) Turbidity point | 12 | 11 | 10 | 11 | 10 | 11 | 10 | 7 | 12–18 |

*gives the values of natural jojoba oil.

What is claimed is:

1. A synthetic liquid wax ester substitute for jojoba oil, consisting essentially of ester mixtures of substantially equivalent amounts of an unsaturated carboxylic acid component (a) and an unsaturated alcohol component (b) wherein (a) is a mixture of $a_1$, $a_2$ and $a_3$ wherein $a_1$=straight-chain fatty acids including
5 to 95% monounsaturated C22 fatty acids,
0 to 10% monounsaturated C20 fatty acids,
0 to 60% monounsaturated C18 fatty acids,
0 to 25% diunsaturated C18 fatty acids, and
0 to 8% triunsaturated C18 fatty acids;

$a_2$=0 to 25% addition products of acrylic acid onto conjugated diunsaturated fatty acids; and $a_3$=0 to 25% dimeric fatty acids; and (b) is a mixture of 0 to 10% unsaturated C12 fatty alcohols
0 to 15% unsaturated C14 fatty alcohols,
0 to 40% unsaturated C16 fatty alcohols,
50 to 95% unsaturated C18 fatty alcohols,
0 to 10% unsaturated C20 fatty alcohols, and
0 to 10% unsaturated C22 fatty alcohols;

wherein all components of (a) and (b) total 100% in each case.

2. Te synthetic liquid wax ester of claim 1 wherein component (b) contains
2 to 15% unsaturated C14 fatty alcohols and
2 to 40% unsaturated C16 fatty alcohols.

3. The synthetic liquid wax ester of claim 2 comprising 0 to 5 wt.% acetyl.

4. The synthetic liquid wax ester of claim 3 further comprising antioxidants.

5. The synthetic liquid wax ester of claim 1 comprising 0 to 5 wt.% acetyl.

6. The synthetic liquid wax ester of claim 1 further comprising antioxidants.

7. The synthetic liquid wax ester of claim 1 wherein component (b) contains 2 to 15% unsaturated C14 fatty alcohols or 2 to 40% unsaturated C16 fatty alcohols.

8. The synthetic liquid wax ester of claim 7 comprising 0 to 5 wt.% acetyl.

9. The synthetic liquid wax ester of claim 8 further comprising antioxidants.

* * * * *